United States Patent [19]

Knoble

[11] Patent Number: 4,931,699

[45] Date of Patent: Jun. 5, 1990

[54] BALLAST SYSTEM INCLUDING A STARTING AID FOR A GASEOUS DISCHARGE LAMP

[75] Inventor: David W. Knoble, East Flat, N.C.

[73] Assignee: General Electric Company, Schenectady, N.Y.

[21] Appl. No.: 294,029

[22] Filed: Jan. 6, 1989

[51] Int. Cl.[5] ..... H05B 41/16; H05B 41/24

[52] U.S. Cl. ..... 315/276; 315/289; 315/258; 315/283; 315/DIG. 5

[58] Field of Search ..... 315/258, 289, 283, DIG. 5, 315/276, 174, 290

[56] References Cited

U.S. PATENT DOCUMENTS

| | | | |
|---|---|---|---|
| 3,917,976 | 11/1975 | Nuckolls | 315/258 |
| 3,963,958 | 6/1976 | Nuckolls | 315/276 |
| 4,601,753 | 7/1986 | Soileau et al. | 75/251 |
| 4,601,765 | 7/1986 | Soileau et al. | 143/104 |

*Primary Examiner*—Eugene R. LaRoche
*Assistant Examiner*—Ali Neyzari
*Attorney, Agent, or Firm*—John P. McMahon; Stanley C. Corwin; Fred Jacob

[57] ABSTRACT

This ballast system for a gaseous discharge lamp comprises a reactor coil and core structure forming a magnetic circuit for flux developed by power-frequency current through the coil during lamp operation. The core comprises a leg surrounded by the reactor coil, two yokes at opposite ends of the leg, and flux-return structure connected between the two yokes radially outside the coil. For developing a high-voltage, high-frequency pulse for initiating lamp operation, there is provided an ignitor coil surrounding the flux-return structure and the reactor coil and inductively coupled to the reactor coil with respect to high-frequency pulse components.

12 Claims, 2 Drawing Sheets

Fig. 3
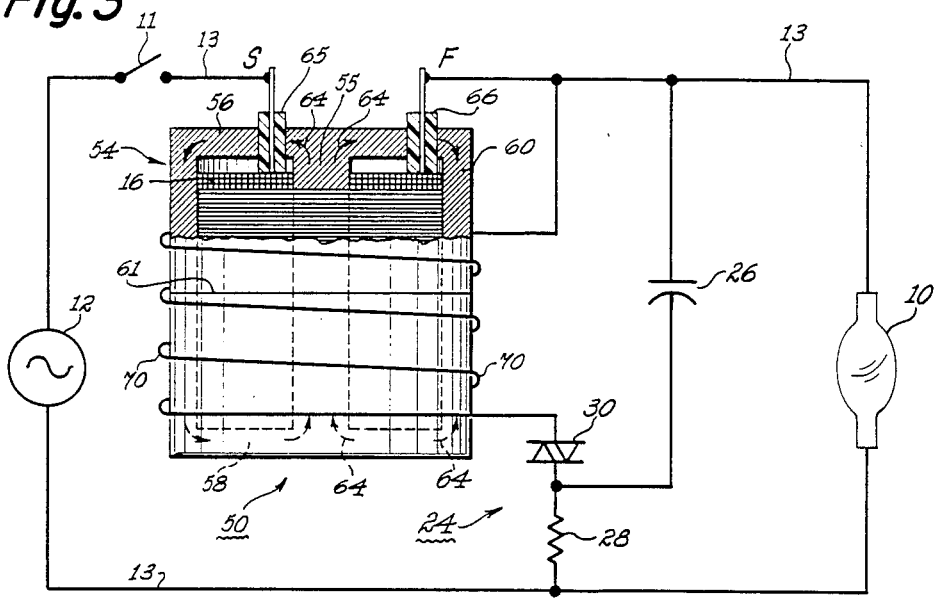
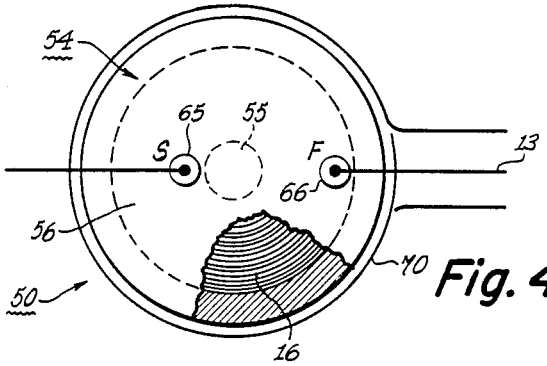
Fig. 4
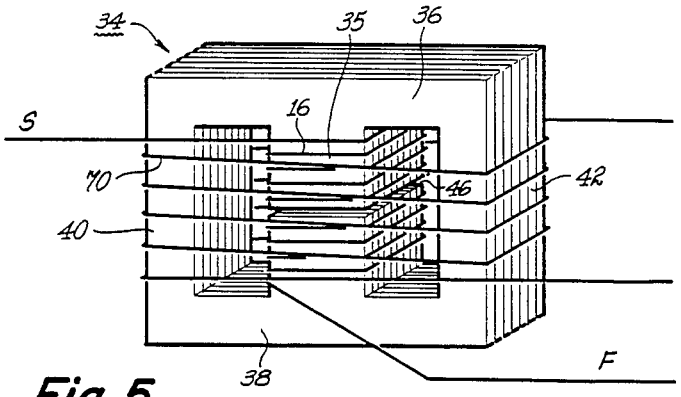
Fig. 5

BALLAST SYSTEM INCLUDING A STARTING AID FOR A GASEOUS DISCHARGE LAMP

This invention relates to a ballast system for a gaseous discharge lamp and, more particularly, relates to a ballast system of this type that includes a starting aid, or ignitor, for developing a high voltage pulse for initiating operation of the lamp.

BACKGROUND

A typical ballast system for a gaseous discharge lamp comprises a ballast reactance, including a reactor coil in circuit with the lamp, for supplying energy to the lamp after the fill gas within the lamp has been initially ionized. This energy promotes glow-to-arc transition and subsequent arc operation. For effecting initial ionization of the fill gas, a starting aid, or ignitor, is provided for developing a high voltage pulse that is applied to the lamp when initiating lamp operation. In the case of a 70 watt high-pressure sodium lamp energized from a 120 volt, 60 Hz line, this high voltage pulse typically has a peak available value of 2500–4000 volts and a width of 1.5 to 15 microseconds at 2250 volts. The pulse should be within ±10 degrees of the peak of the sinusoidal line voltage. Without a starting aid, the typical 70 watt high-pressure sodium lamp will not initiate operation when the above line voltage is applied to the lamp.

The most common type starting aid utilizes a tap on the reactance coil of the ballast. A typical starting aid circuit that employs this approach is illustrated in U.S. Pat. Nos. 3,917,976 and 3,963,958 - Nuckolls, assigned to the assignee of the present invention. One disadvantage of relying upon a tap on the reactance coil is that it is expensive to manufacture a reactor coil that includes such a tap. Another disadvantage is that certain types of ballast, such as the pot-core ballast, do not readily lend themselves to the inclusion of a tap of the type here required, i.e., one to which a high voltage pulse is applied and which requires high voltage insulation to maintain the required dielectric strength. In the pot-core type ballast, grounded core structure completely envelopes the reactor coil, and this leads to difficulties and expenses in providing for a properly insulated tap.

Another type of starting aid is the so-called "remote" starting aid, which is sometimes utilized when the ballast reactor is far removed from the lamp. These starting aids contain high frequency transformers separate from the ballast reactor and in series with the lamp. Because these separate high frequency transformers are relatively expensive, this type of starting aid is typically considerably more expensive than the conventional tapped reactor type starting aid.

OBJECTS

An object of my invention is to provide, for developing a high voltage pulse for initiating lamp operation, a simple and relatively inexpensive starting aid that utilizes as one of its components the reactor coil of the ballast system and yet does not require a tap on the reactor coil.

Another object is to provide a starting aid that is capable of fulfilling the immediately-preceding object and is easily usable with a pot-core type ballast reactor.

SUMMARY

In carrying out the invention in one form, I provide a ballast system that comprises a reactor coil for connection in series with a gaseous discharge lamp and for energization by power-frequency current during lamp operation. The ballast system also comprises core structure of magnetizable material forming a magnetic circuit for flux developed by power-frequency current through the coil. The core structure comprises a leg surrounded by the reactor coil, two yokes at opposite ends of the leg, and flux-return structure connected between the two yokes radially outside the coil. The ballast system also includes means for developing a high voltage pulse of a pulse width equal to that characteristic of a kilocycle voltage wave for initiating operation of the lamp. This pulse-developing means comprises: (i) an ignitor coil surrounding the flux-return structure and the reactor coil and inductively coupled to the reactor coil with respect to pulse components in the kilocycle frequency range, and (ii) means for supplying a high rate-of-change current pulse to the ignitor coil, thereby inducing the desired high voltage pulse across the reactor coil for application to the lamp.

BRIEF DESCRIPTION OF DRAWINGS

For a better understanding of the invention, reference may be had to the following detailed description taken in conjunction with the accompanying drawings, wherein:

FIG. 3 is a partially-sectional, partially-schematic view of a ballast system embodying one form of the present invention.

FIG. 4 is a plan view, partially sectional, of a ballast reactor constituting a portion of the ballast system of FIG. 3.

FIG. 5 is a schematic showing of a modified form of ballast reactor for use in a ballast system similar to that of FIG. 3.

DETAILED DESCRIPTION OF EMBODIMENTS

Figure 1:
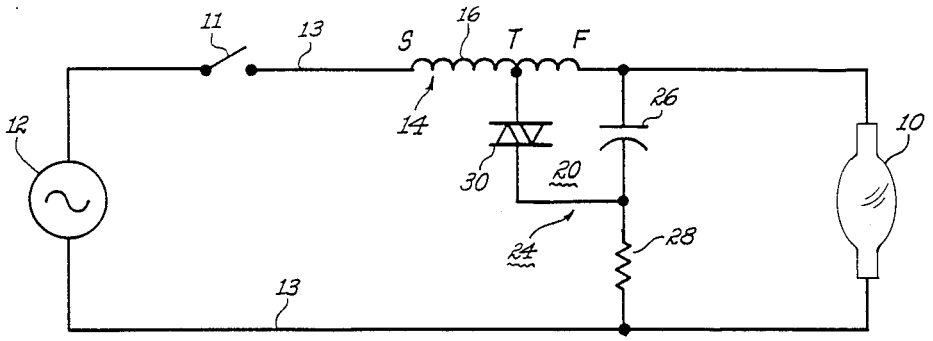
Fig. 1 (PRIOR ART)
FIG. 1 is a circuit diagram of a prior art ballast system for a gas discharge lamp.

Referring first to the prior art circuit of FIG. 1, there is shown a lamp 10 of the gaseous discharge type, e.g., a high-pressure sodium lamp with a 70 watt power rating. Power for this lamp is supplied by an a-c power source 12 rated, for example, at 120 volts r.m.s. connected across the lamp by a power circuit 13. In series with the lamp 10 and the source 12 in the circuit 13 is a starting switch 11 and a ballast reactance 14 in the form of a reactor coil 16 having a start terminal S and a finish terminal F at its opposite ends. This reactance 14 serves in a conventional manner during lamp operation to stabilize the arc within the lamp, e.g., by supplying energy to promote transition between the glow state and the arcing state, to preclude premature extinction of the arc and to limit current through the arc.

For initiating an arc when the lamp is to be initially turned on by closing of switch 11, a starting aid 20 is provided. This starting aid comprises a tap T on the reactor coil 16 which divides the coil 16 into two portions, one (T-S) between the tap T and the start terminal S and the other (T-F) between the tap T and the finish terminal F. The T-F portion of the reactor coil typically has 3–10% of the total number of turns between terminals S and F. The reactor coil 16 may be considered to be an autotransformer in which the coil portion T-F is the primary of the transformer and the total winding S-F is the secondary of the transformer. Thus, when a voltage pulse is applied to the primary winding T-F, a much higher voltage pulse is developed across the S-F secondary winding, the amplitude of the latter voltage pulse being controlled by the turns ratio of the S-F portion to the T-F portion. The high voltage pulse appearing across secondary winding S-F is applied to the series combination of the source 12 and the lamp 10. Since the lamp is essentially non-conducting at this instant, most of the pulse voltage appears across the lamp and acts to ionize the fill gas between the lamp electrodes, thus initiating lamp operation.

For developing the above-described voltage pulse across the primary winding portion T-F, a pulse-generating circuit 24, constituting a part of the starting aid 20 is provided. This pulse-generating circuit 24 comprises the series combination of a capacitor 26 and a resistor 28 connected across the lamp 10 and in series with the reactor coil 16 in the power circuit 13. Connected in parallel with the series combination of capacitor 26 and the T-F portion of the reactor coil 16, in the power circuit 13, is a bilaterally-conducting solid-state break-over device 30 of the type often referred to as a sidac. This device 30 has a normal high-resistance, essentially non-conducting state. But when the voltage across this device 30, irrespective of polarity, reaches a predetermined threshold level, the device rapidly switches from its high resistance state to a very low resistance state. This allows the capacitor 26 to rapidly discharge through the series combination of the sidac 30 and the T-F portion of the winding 16 in the form of a current pulse having a steeply-rising wave front. This current pulse, in passing through the winding portion T-F, develops the desired high-frequency voltage pulse thereacross. The shape of this pulse is controlled by the inherent inductance of the T-F portion of the coil and the value of the capacitance.

When the capacitor has thus discharged, the current through the sidac 30 falls to a relatively low value, allowing the sidac 30 to recover to its original high-resistance state.

Figure 2:
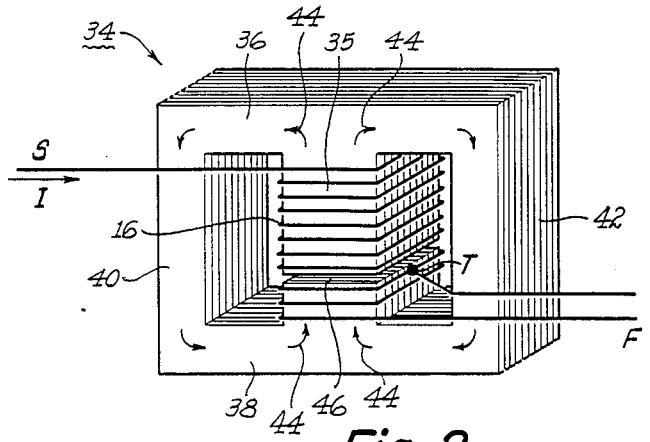
Fig. 2 (PRIOR ART)
FIG. 2 is a schematic perspective view of a ballast reactor constituting a part of the ballast system of FIG. 1.

The ballast system of FIG. 1 typically includes magnetizable core structure of the type shown at 34 in FIG. 2. This core structure comprises a centrally-located leg 35, which is surrounded by the coil 16, and two yokes 36 and 38 at opposite ends of the leg 35. These yokes extend transversely of the leg 35, projecting laterally outward from the leg. At the outer ends of the yokes 36 and 38, there is flux-return structure in the form of two legs 40 and 42 extending between the yokes in locations outside the coil 16. When the coil 16 is energized by current I flowing therethrough between its terminals S and F, magnetic flux is developed which follows the path illustrated by the arrows 44 through the magnetic circuit defined by the core structure. A short air gap 46 is present in the central leg 35 to control its saturation level and the magnitude of the reactance.

The tap T on the coil is shown near the bottom terminal F of the coil. As pointed out in the introductory portion of this application, a disadvantage of the tapped reactor type of ballast system is that it is relatively expensive to manufacture a coil tapped in this manner. During the coil winding process, the winding operation must be stopped, the tap drawn, and the winding operation started again. This is time-consuming and therefore relatively expensive.

Another disadvantage of the tapped-reactor approach is that it is not easily usable with a pot-core type of ballast reactor. Such a pot-core type of ballast reactor is shown in FIG. 3 at 50. This reactor comprises core structure 54 that substantially completely envelopes the coil 16 of the reactor. This core structure comprises a centrally-disposed leg 55, which is surrounded by coil 16 as shown in FIGS. 3 and 4, and two yokes 56 and 58 at opposite ends of leg 55. Each of the yokes is of circular plate form and extends transversely of the leg 55, projecting radially outward of the leg about the entire periphery of the leg. Near the outer periphery of the yokes, there is tubular flux-return structure 60 extending between the yokes and surrounding the coil 16. Preferably, the core structure 54 of FIG. 3 comprises an upper half and a lower half of substantially the same overall form and size. The form of each half may be thought of as a pot form, assuming the central leg is disregarded. These halves, the open ends of which face each other, meet along a horizontal seam 61. They are held together by a centrally disposed clamping bolt (not shown) which extends between opposite ends of the core structure. The composite core structure is referred to herein as a pot-form core. This pot-form core type of ballast reactor is described in more detail in U.S. Pat. Nos. 4,601,753—Soileau et al and 4,601,765—Soileau et al, both assigned to the assignee of the present invention and incorporated by reference in the present application. Preferably, each of the core halves is made by compressing the coated iron powder disclosed in those patents and then annealing the resulting compact, all as disclosed and claimed in those patents.

In the core structure of FIG. 3, the flux developed by current through coil 16 follows paths 64 similar to those depicted at 44 in FIG. 2. More specifically, in FIG. 3 the flux emerging from the upper end of the leg 55 flows radially outward through the upper yoke 56, then through the tubular flux-return structure 60, and then radially inward through the lower yoke 58 into the lower end of the leg. This flux is angularly distributed about the entire tubular flux-return structure 60.

The terminals S and F of the coil 16 of FIG. 3 are connected to the coil through tubular insulating nipples 65 and 66 respectively extending through closely-fitting holes in the upper yoke 56 of the core structure 54. Each of these nipples surrounds the lead wire connected between the associated terminal and the coil 16 and provides high voltage insulation between the lead wire and the grounded core structure surrounding the nipple.

Partially because the core structure 54 of FIGS. 3 and 4 substantially completely envelopes the core 16, it is difficult and expensive to incorporate a tap within the coil corresponding to the tap T of FIGS. 1 and 2. One problem is that a separate passage must be made through the core structure to accommodate the conductive lead for the tap, and expensive insulation needs to be present about the lead and tap to provide adequate dielectric strength between these parts and the adjacent grounded core structure.

FIG. 3 illustrates a ballast system that includes a starting aid that requires no tap for developing the desired voltage pulse for initiating lamp operation. In this ballast system, a coil 70, referred to hereinafter as an ignitor coil, is disposed about the entire core structure 54, surrounding the tubular flux-return structure 60 and the reactor coil 16. This ignitor coil 70 has only about 3–10 percent of the number of turns in reactor coil 16 and is connected into the power circuit 13 completely externally of reactor coil 16 and thus without any tap. The ignitor coil 70 is supplied with a high rate-of-change current pulse by a pulse-generating circuit 24 essentially the same as the pulse-generating circuit 24 of FIG. 1. Corresponding components of the two pulse-generating circuits 24 are identified with corresponding reference numerals.

These two circuits 24 operate in essentially the same manner. More particularly, when the voltage across the sidac device 30 reaches a predetermined threshold value, the device 30 rapidly switches from its normal high-resistance state to its low-resistance state, causing the capacitator 26 to rapidly discharge through the ignitor coil 70, thus supplying the desired current pulse to the ignitor coil.

This current pulse through the ignitor coil 70 is able to induce in the ballast coil 16 a voltage pulse that is able to effectively initiate operation of the lamp 10 when applied to the lamp. I found this performance to be somewhat unexpected because the tubular iron structure 60 of FIGS. 3 and 4 appeared to form a low reluctance shunting path of least energy around the reactor coil 16 for flux developed by ignitor coil 70. Indeed, if one energizes the ignitor coil 70 with a 60 Hz voltage, no measurable voltage is induced in the reactor coil 16. But when the ignitor coil 70 is energized by a high-frequency pulse in the kilohertz range, a voltage of the required amplitude is developed across the reactor coil. A possible explanation for this difference in performance is that at high frequencies (50 KHz and higher), the magnetic flux coupling between the two coils is primarily through an air magnetic circuit rather than through the steel magnetic circuit. It appears that the steel is ineffective at shunting the flux around the center coil 16 at the frequencies of interest for the starting aid.

Although I have referred to the pulse developed by discharge of capacitor 26 as having a frequency in the kilohertz range, it is to be understood that this is not meant to imply that the pulse is repeated at any such rate. The term is meant simply to denote that the pulse has a duration, or pulse width, equal to that which is characteristic of a voltage wave of this frequency. Normally, only one pulse will be developed on each half cycle of power frequency voltage until lamp operation begins. Following capacitor discharge on a given half cycle of power frequency voltage, there is normally insufficient time during that half cycle to again charge the capacitor to a level that would cause breakover of sidac 30. After lamp operation begins and while the lamp is in operation, the pulse generating means 24 is disabled as a result of the voltage clamping action of the ignited lamp load, which prevents the voltage build-up across the capacitor 26 from reaching the breakover level of the sidac 30.

Another way of describing the voltage pulse for initiating lamp operation is in terms of pulse width. This width is much shorter than the width of each half cycle of power frequency voltage and is preferably in the range of 1 microsecond to 20 microseconds at 2000 volts.

By way of example and not limitation, the components of the circuit of FIG. 3 may have the following values:

| | |
|---|---|
| capacitor 26 | 0.47 microfarads |
| resistor 28 | 3.3 kilo-ohms |

-continued

| | |
|---|---|
| sidac 30 | 100 volt breakover voltage |
| reactor coil 16 | 360 turns; inductance at 60 Hz of 0.18 henries |
| ingnitor coil 70 | 15 turns |
| lamp 10 | high-pressure sodium vapor lamp rated at 120 volts, 70 watts |
| source 12 | 120 volts r.m.s. |

The timing of the high voltage pulse with respect to the power frequency voltage is determined by the breakover voltage of the sidac 30 in combination with the resistor 28 and capacitor 26. This breakover voltage is selected so that the high voltage pulse is applied to the lamp within 10 degrees of peak power-frequency voltage.

FIG. 5 shows an embodiment of the invention in which a core structure similar to that of FIG. 2 is utilized. In FIG. 5, the tap T of FIG. 2 is omitted, and an ignitor coil 70 similar to that of FIGS. 3 and 4 is utilized. The ignitor coil 70 surrounds the entire core structure 34 and the reactor coil 16. Ignitor coil 70 is connected in a pulse-generating circuit (not shown in FIG. 5) corresponding to the pulse-generating circuit 24 of FIG. 3.

Figure 6:
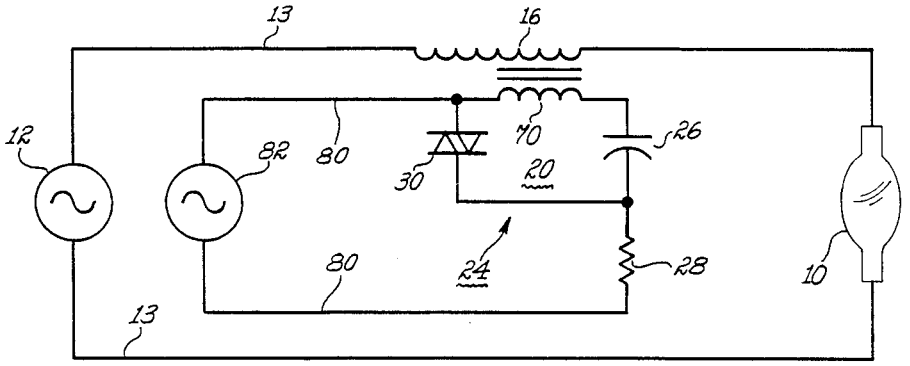
FIG. 6 is a circuit diagram of a modified ballast system embodying another form of the invention.

Although FIG. 3 shows the pulse-generating circuit 24 connected across the conductors of the power circuit 13, this is not essential. For example, as shown in FIG. 6, the pulse-generating circuit can be connected in a circuit 80 separate from the power circuit 13. The source 82 of circuit 80 is, however, suitably synchronized with the source 12 of the power circuit so that the lamp-starting pulse is developed at the appropriate instant on the voltage wave of the power circuit voltage, for example, within ±10 degrees of peak power-circuit voltage.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. A ballast system for a gaseous discharge lamp comprising:

(a) a reactor coil for connection in series with said lamp and adapted to be energized with power-frequency current during lamp operation, (b) core structure of magnetizable material forming a magnetic circuit for flux developed by power-frequency current through said coil and comprising the following components: a leg surrounded by said coil, two yokes at opposite ends of said leg, and flux-return structure connected between said yokes radially outside said coil, (c) means for developing a high voltage pulse of a pulse width equal to that characteristic of a kilocycle voltage wave for initiating operation of said lamp, comprising:

(i) an ignitor coil surrounding said flux-return structure and said reactor coil and inductively coupled to said reactor coil with respect to pulse components in the kilocycle frequency range, and (ii) means for supplying a high rate-of-change current pulse to said ignitor coil, thereby inducing said high voltage pulse across said reactor coil for application to said lamp.

2. The ballast system of claim 1 in which:

(a) each of said yokes comprises structure extending transversely of said leg, each yoke having a larger cross-section transversely of said leg than the portion of said leg surrounded by said reactor coil, and (b) said flux-return structure is of a tubular form, extends between said yokes, and surrounds said reactor coil.

3. The ballast system of claim 1 in which:

(a) said yokes extend transversely of said leg and project radially outward of the periphery of said leg, and (b) said flux-return structure extends between said yokes in a location disposed radially-outwardly of said coil.

4. The ballast system of claim 3 in which said flux-return structure is of a tubular form and surrounds said reactor coil.

5. The ballast system of claim 1 in which said means for developing said high voltage pulse comprises:

(a) a capacitor that is charged by a.c. voltage bearing a substantially fixed phase relationship with the a.c. voltage applied to said reactor coil during lamp operation, and (b) means for effecting rapid discharge of said capacitor when the voltage applied to said capacitor reaches a predetermined level, thereby developing said high rate-of-change current pulse for supply to said ignitor coil.

6. The ballast system of claim 1 in which said means for developing said high voltage pulse comprises:

(a) a capacitor, (b) means for effecting rapid discharge of said capacitor when the voltage applied to said capacitor reaches a predetermined level, thereby developing said high rate-of-change current pulse for supply to said ignitor coil.

7. A ballast system for a gaseous discharge lamp comprising:

(a) a reactor coil for connection in series with said lamp and adapted to be energized with power-frequency current during lamp operation, (b) core structure of magnetizable material forming a magnetic circuit for flux developed by power-frequency current through said coil and comprising the following components: a leg surrounded by said coil, two yokes at opposite ends of said leg, and flux-return structure connected between said yokes radially outside said coil, (c) means for developing a high voltage pulse of a pulse-width orders of magnitude shorter than the width of a loop of power-frequency voltage for initiating operation of said lamp, comprising:

(i) an ignitor coil surrounding said flux-return structure and said reactor coil and inductively coupled to said reactor coil with respect to pulses having a width orders of magnitude shorter than the width of a loop of power-frequency voltage, and (ii) means for supplying a high rate-of-change pulse to said ignitor coil, thereby inducing said high voltage pulse across said reactor coil for application to said lamp.

8. The ballast system of claim 7 in which:

(a) said yokes extend transversely of said leg and project radially outward of the periphery of said leg, and (b) said flux-return structure extends between said yokes in a location disposed radially-outwardly of said coil.

9. The ballast system of claim 8 in which said flux-return structure is of a tubular form and surrounds said reactor coil.

10. The ballast system of claim 7 in which said means for developing said high voltage pulse comprises:

(a) a capacitor that is charged by a.c. voltage bearing a substantially fixed phase relationship with the a.c. voltage applied to said reactor coil during lamp operation, and (b) means for effecting rapid discharge of said capacitor when the voltage applied to said capacitor reaches a predetermined level, thereby developing said high rate-of-change current pulse for supply to said ignitor coil.

11. The ballast system of claim 1 in which said high voltage pulse has a pulse width of about 1 to 20 microseconds at 2000 volts.

12. The ballast system of claim 7 in which said high voltage pulse has a pulse width of about 1 to 20 microseconds at 2000 volts.

* * * * *